US007713137B2

(12) United States Patent
Doerr

(10) Patent No.: US 7,713,137 B2
(45) Date of Patent: May 11, 2010

(54) CLUB GRIP

(75) Inventor: Christopher L. Doerr, Grafton, WI (US)

(73) Assignee: Technique Golf, L.L.C., Warren, MI (US)

( * ) Notice: Subject to any disclaimer, the term of this patent is extended or adjusted under 35 U.S.C. 154(b) by 40 days.

(21) Appl. No.: 12/048,097

(22) Filed: Mar. 13, 2008

(65) Prior Publication Data

US 2009/0233730 A1 Sep. 17, 2009

(51) Int. Cl.
*A63B 53/14* (2006.01)

(52) U.S. Cl. ..... 473/299; 473/300

(58) Field of Classification Search ..... 473/300–303, 473/549–552, 568, 298–299; D21/756; D8/DIG. 6, D8/DIG. 7, DIG. 8; 74/551.9; 81/489–490, 81/492; 16/421, 430, DIG. 12, DIG. 18, 16/DIG. 24; 280/821
See application file for complete search history.

(56) References Cited

U.S. PATENT DOCUMENTS 3,606,326 A 9/1971 Sparks et al.
3,915,782 A 10/1975 Davis et al.
4,093,282 A * 6/1978 Kyriakodis ..... 285/114
4,313,250 A 2/1982 Sokolowski
5,407,026 A 4/1995 Vald'via
5,419,031 A 5/1995 McLendon
5,429,706 A 7/1995 Cresse et al.
5,439,217 A 8/1995 Ganger, Sr.
5,741,394 A 4/1998 Kennedy
5,909,912 A 6/1999 Mueller
6,401,321 B2 6/2002 Carey et al.
6,460,237 B1 10/2002 Tsiguloff
6,626,768 B2 9/2003 Roelke
7,076,849 B2 7/2006 Bettencourt et al.
7,563,174 B1 * 7/2009 Hung ..... 473/300

* cited by examiner

*Primary Examiner*—Stephen L. Blau
(74) *Attorney, Agent, or Firm*—Helmholdt Law PLC; Thomas D. Helmholdt

(57) ABSTRACT

A club grip includes an elongated body having an upper end and a lower end. The lower end has a hollow portion for receiving a shaft therein. A clamp is fixed in the hollow portion for clamping onto the shaft received therein to fix the shaft relative to the elongated body.

8 Claims, 4 Drawing Sheets

CLUB GRIP

CROSS REFERENCES TO RELATED APPLICATIONS

Not applicable.

STATEMENT REGARDING FEDERALLY SPONSORED RESEARCH

Not Applicable

TECHNICAL FIELD

This invention relates to grips, in particular grips fixed to a shaft, such as a golf grip.

DESCRIPTION OF THE BACKGROUND ART

Golf clubs typically include a shaft having an upper end and a lower end. A head fixed to the lower end is used to strike a gold ball. A grip fixed to the upper end provides a surface and geometry that allows the user to control the head and accurately hit the ball.

Golf club grips are typically fixed to a shaft using adhesives. As a result, improper initial placement of the grip on the shaft is important because once the adhesive sets, repositioning of the grip is impossible. In order to correct an improperly installed grip, the existing grip must be completely removed. If the improperly installed grip is damaged during removal, it must be discarded and a new grip must be provided. Moreover, replacing worn out grips is also difficult because the adhesive must be removed from the shaft prior to attaching a new grip. Accordingly, a need exists for a grip that can be easily fixed to and removed from a shaft.

SUMMARY OF THE INVENTION

One embodiment of the present invention provides a club grip that can be easily fixed to and removed from a shaft. The club grip includes an elongated body having an upper end and a lower end. The lower end has a hollow portion for receiving a shaft therein. A clamp is fixed in said hollow portion for clamping onto the shaft received therein to fix the shaft relative to the elongated body.

A general objective of the present invention is to provide a grip that is easily fixed to and removed from a shaft. This objective is accomplished by providing the grip with a body having a clamp fixed thereto. The clamp fixes the shaft relative to the body.

The foregoing and other objects and advantages of the invention will appear from the following description. In the description, reference is made to the accompanying drawings which form a part hereof, and in which there is shown by way of illustration a preferred embodiment of the invention.

DETAILED DESCRIPTION OF THE PREFERRED EMBODIMENTS

Figure 1:
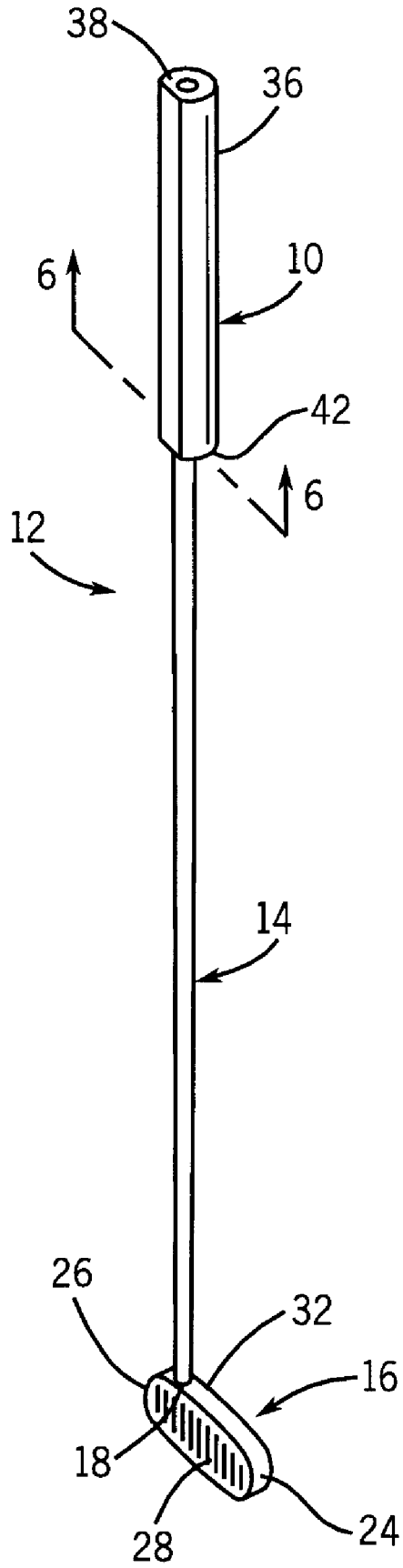
FIG. 1 is a perspective view of a golf club including a grip incorporating the present invention.
Figure 2:
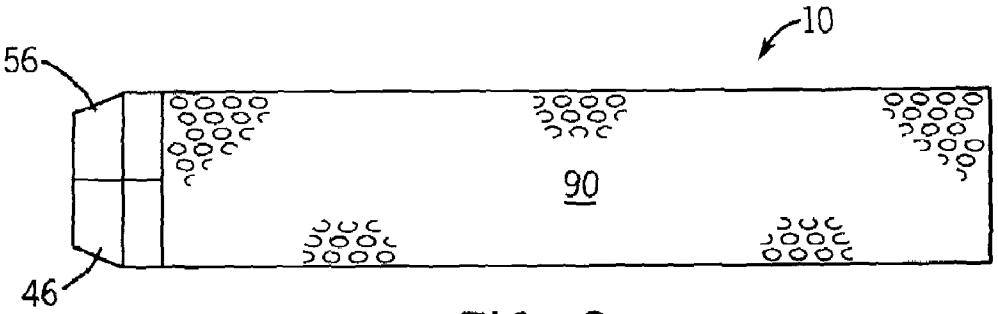
FIG. 2 is a side view of the grip of FIG. 1.
Figure 3:
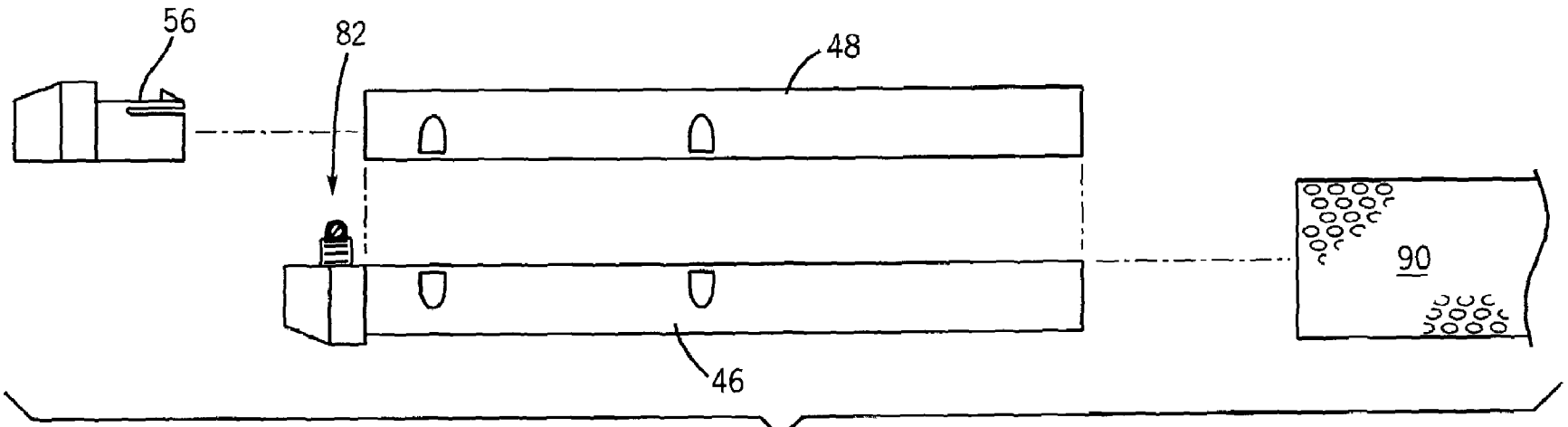
FIG. 3 is an exploded view of the grip of FIG. 2.
Figure 4:
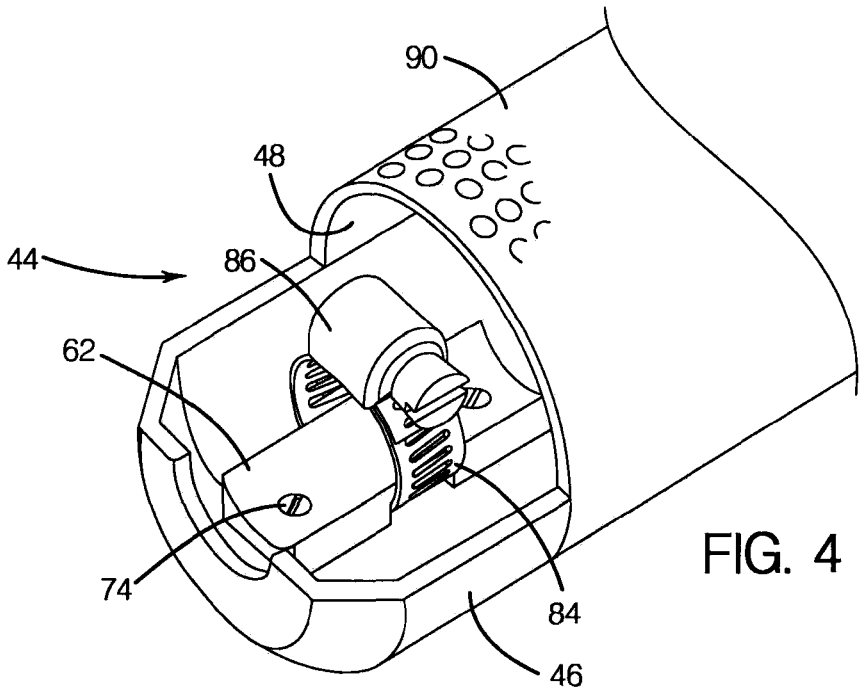
FIG. 4 is a perspective cut away end view of the grip of FIG. 2.
Figure 5:
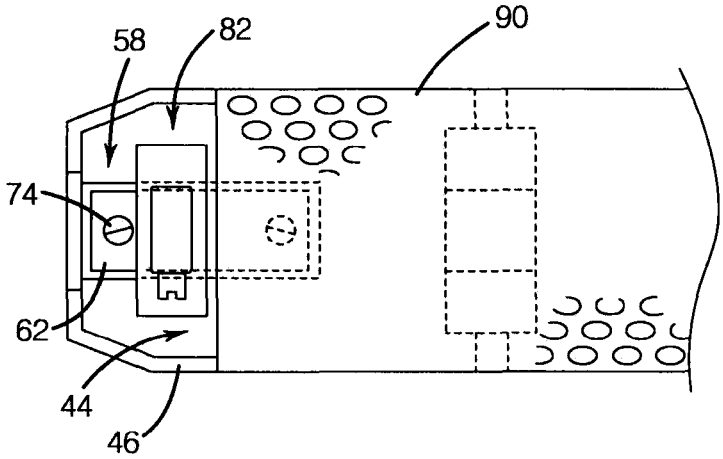
FIG. 5 is a side view of the cut away grip of FIG. 4.
Figure 6:
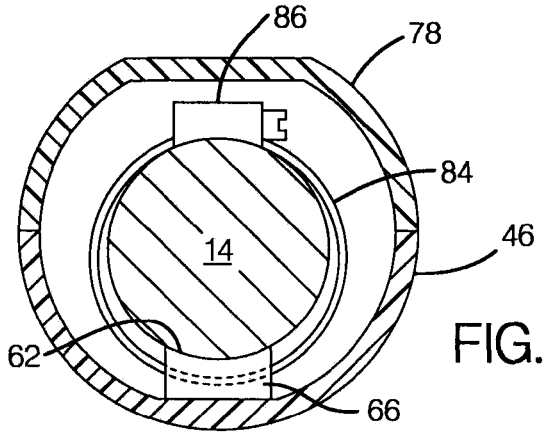
FIG. 6 is a sectional view along line 6-6 of FIG. 1.
Figure 7:
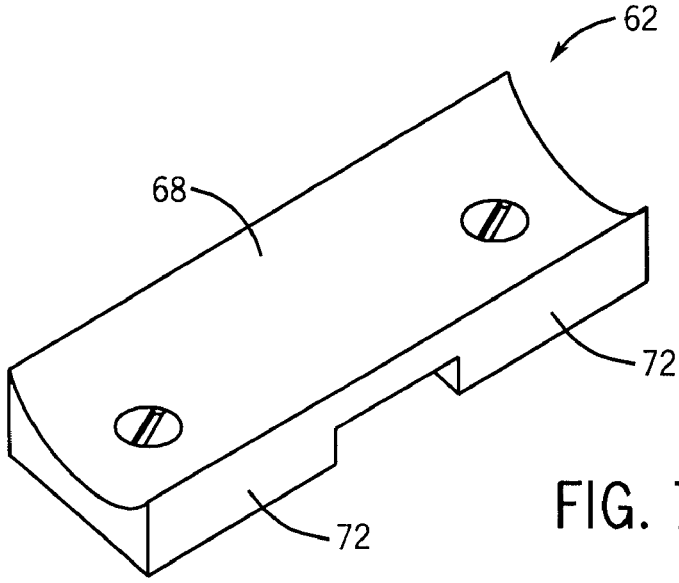
FIG. 7 is a perspective view of the shelf of FIG. 5.

A club grip 10, shown in FIGS. 1-3, attaches to a shaft 14 with a head 16 fixed to a distal end 18 forms a golf club 12. The grip 10 is fixed to a proximal end 22 of the shaft 14 for grasping of a user. The golf club 12 disclosed herein is a conventional putter except for the grip constructed in accordance with a preferred embodiment of the invention. Although a putter is disclosed, the grip can be used with any type golf club including irons and drivers without departing from the scope of the invention. Moreover, the grip can also be used with other devices having shafts requiring a grip, such as racquets, mallets, and the like, without departing from the scope of the invention.

The head 16 may be any commercially available golf club head formed from aluminum, brass, or any other material commonly used in putter heads. As is conventional, the head includes a front toe 24, a rear heel 26, a flat striking face 28 designed to engage the ball, and a top surface 32.

The shaft 14 is also conventional and may be formed from a steel tube, graphite or any other material commonly used in shafts. The shaft 14 has the proximal, or upper, end 22 which is covered by the grip 10 and the distal, or lower, end 18 which is attached to the head 16. The shaft 14 is generally cylindrical and, therefore, has a longitudinal axis 34.

A preferred embodiment of the grip 10 includes an elongated tubular molded body 36. The body 36 may be molded from a single material such as natural rubber, silicon rubber, plastic, or any other material commonly used in putter grips. The body 36 has an upper end 38 which is fully or partially closed either by an end portion molded integrally with the remainder of the body 36 or by a cap or plug capable of fitting onto or into the upper end of the shaft 14. The body 36 further includes a lower end 42 having a hollow portion 44 which is open so as to be capable of receiving the proximal end 22 of the shaft 14 therein.

In the embodiment disclosed herein, the body 36 is longitudinally split into halves 46, 48 to simplify fabrication. The halves 46, 48 are fixed to each other by mechanical fasteners (not shown) extending through apertures 52 formed in one half 46 and threadably engaging bosses in the other half 48. One of the halves 46 is split into two pieces, a body portion 54 and a detachable cover 56. The detachable cover 56 covers the hollow portion 44 and provides access thereto. Although mechanical fasteners fixing the body halves 46, 48 to each other is preferred, the body halves 46, 48 can be formed as an integral piece, joined using adhesives, snap-fit together, and the like without departing from the scope of the invention.

In the embodiment shown in FIGS. 4-7, an anchor 58 disposed in the hollow portion 44 of one of the body halves 48 is fixed to the body 36. In a preferred embodiment, the anchor 58 includes a shelf 62 spaced from an interior radially inwardly facing surface 64 of the body 36 to define a gap 66 between the shelf 62 and body 36. Preferably, a radially inner surface 68 of the shelf 62 is concave for securely engaging a convex longitudinal surface of the proximal end 22 of the cylindrical shaft 14 and preventing transverse movement of the shaft 14 relative to the anchor 58. Although a shelf 62 having a concave inner radial surface 68 for engaging the shaft 14 is preferred, the shelf 62 can have any surface or surfaces engaging the shaft 14 without departing from the scope of the invention.

The shelf 62 extends longitudinally in the hollow portion 44. Each end of the shelf 62 is supported on feet 72 extending radially outwardly toward the interior surface 64 of the body 36. Preferably, the anchor 58 is fixed to the body 36 using mechanical fasteners 74, such as screws, extending through opposing ends 76, 78 of the shelf 62 and the feet 72 to engage the body 36. Although mechanical fasteners 74 securing the anchor 58 to the body 36 are preferred, other means for fixing the anchor 58 relative to the body 36 can be used, such as adhesives, integrally forming the anchor with the body, clamping the anchor in the hollow portion, and the like, without departing from the scope of the claims.

A clamp 82 fixed to the body 36 by the anchor 58 clamps onto the shaft proximal end 22 to fix the grip 10 to the shaft 14. Preferably, the clamp 82 is a hose clamp having a slotted band 84 wrapping around the shelf 62 through the gap 66 and a worm drive 86. The worm drive 86 engages slots 88 in the band 84 to move ends of the band 84 relative to each other and tighten the band 84 around the shaft 14 and clamp onto the shaft 14. Although a hose clamp is preferred, other clamps, such as a bar clamp, tube clamp, and the like, can be used without departing from the scope of the invention.

In a preferred embodiment, a stretchable skin 90 slips over the exterior surface 92 of the body 36 to provide a replaceable soft covering over the body 36. The skin covers the mechanical fasteners securing the body halves 46, 48 together and provides a tactile feel for the user.

Figure 8:
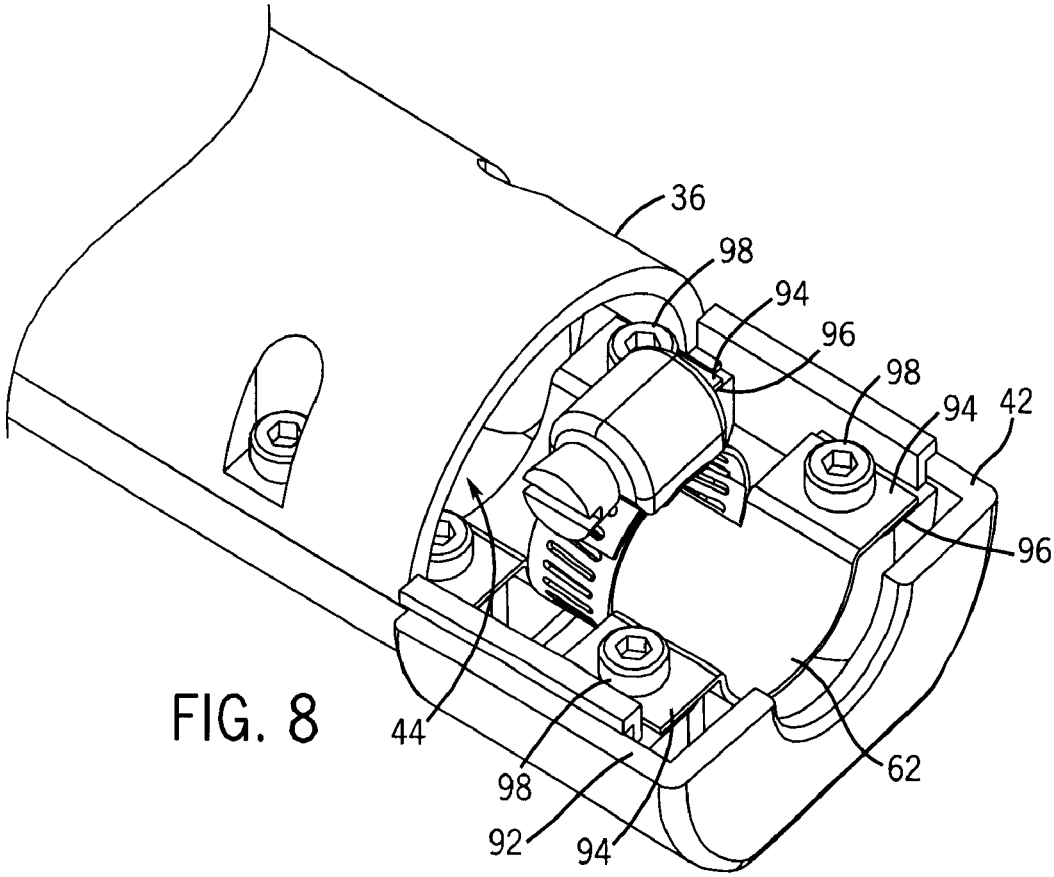
FIG. 8 is a perspective view of an alternate grip with the cover removed.

In another embodiment shown in FIG. 8, the concave surface 68 of the shelf 62 extends longitudinally in the hollow portion 44. Wings 94 extending transversely relative to the shelf 62 extend over bosses 96 forming part of the body 36. A mechanical fastener 98 extends through each wing 94 and threadably engages the underlying boss 96 to fix the anchor 58 to the body 36.

The golf grip 10 is assembled by slipping the shelf 62 through the center of the band 84 having the band ends fixed relative to each other by the worm drive 86. The shelf 62 is then fixed to the body half 48 by the mechanical fasteners 74. The halves 46, 48 of the body 36 are then joined together and the shaft upper end 22 is slipped into the body 36 through the center of the band 84. The band 84 is then tightened around the shaft 14 by turning the worm drive 86 which moves the band ends relative to each other. Once the band 84 is securely tightened around the shaft 14 fixing the shaft 14 to the body 36, the cover 56 is placed over the hollow portion 44 and the skin 90 is slipped over the body 36.

Of course, many modifications could be made to the invention as described and illustrated without departing from the spirit of the present invention. For example, two or more clamps can be provided to more securely fix the grip to the shaft. The scope of such changes will become apparent from the appended claims.

I claim:

1. A club grip comprising:

an elongated body having an upper end and a lower end, said lower end having a hollow portion for receiving a shaft therein; and an elongated anchor coupled to said elongated body so that a gap is formed between said elongated body and the anchor;

a clamp disposed around the anchor within said hollow portion for clamping onto the shaft received therein to fix the shaft relative to the elongated body and against the anchor.

2. The club grip as in claim 1 wherein said body is split longitudinally into at least two parts, and said clamp is fixed to at least one of said at least two parts.

3. The club grip as in claim 1 wherein said anchor is fixed to said body by at least one mechanical fastener.

4. The club grip as recited in claim 3 wherein the anchor comprises wings extending therefrom, said wings each receiving one of the at least one mechanical fastener.

5. The club grip as in claim 1 wherein said anchor includes a shelf having a concave surface for engaging the shaft.

6. The club grip as in claim 1 wherein said clamp comprises a hose clamp.

7. A golf club comprising:

the club grip as in claim 1;

a shaft comprising a distal; and a golf club head fixed to the shaft.

8. The golf club as in claim 7 wherein said shaft is received in said hollow portion and engaged by said clamp to fix said shaft to said body.

* * * * *